US005480456A

United States Patent [19]

Pore et al.

[11] Patent Number: 5,480,456

[45] Date of Patent: Jan. 2, 1996

[54] SILICA SOLS FOR OBTAINING A HIDE WHICH IS CALLED A STABILIZED PICKLED OR WHITE OR STABILIZED WHITE

[75] Inventors: Jean Pore, Yerres, France; Sergio Cuccodoro, Turino, Italy; Jean P. Moretti, Bougival; Patrice Rouet, Cuise Lamotte, both of France

[73] Assignee: Societe Francaise Hoechst, Puteaux, France

[21] Appl. No.: 253,578

[22] Filed: Jun. 3, 1994

Related U.S. Application Data

[63] Continuation of Ser. No. 3,656, Jan. 13, 1993, abandoned.

[30] Foreign Application Priority Data

Jan. 14, 1992 [FR] France ..... 92 00304

[51] Int. Cl.[6] ..... C14C 1/00; C14C 3/06; C14C 9/00

[52] U.S. Cl. ..... 8/94.18; 8/94.15; 8/94.26; 8/94.27; 8/94.33; 8/94.21; 252/8.57

[58] Field of Search ..... 8/94.15, 94.18, 8/94.19, 94.21, 94.26, 94.33, 94.25, 94.27; 252/8.57

[56] References Cited

U.S. PATENT DOCUMENTS

| | | | |
|---|---|---|---|
| 2,276,315 | 3/1942 | Kirk | 8/94.33 |
| 4,978,361 | 12/1990 | Fuchs et al. | 8/94.27 |
| 5,147,693 | 9/1992 | Communal et al. | 8/94.15 |
| 5,215,542 | 6/1993 | Pore | 8/94.15 |

FOREIGN PATENT DOCUMENTS

| | | |
|---|---|---|
| 0339437 | 4/1989 | European Pat. Off. . |
| 437997 | 12/1990 | European Pat. Off. . |

OTHER PUBLICATIONS

Sharphouse, *Leatherworker's Handbook,* Vernon Lock Ltd, Great Britain, pp. 4, 48–49 and 56–58, (1963). (Month Unknown).

Thorstensen, *Practical Leather Technology,* Krieger Publishing Co., N.Y., pp. 34–35 and 39–40, (1969). (Month Unknown).

*Primary Examiner*—Prince Willis, Jr.
*Assistant Examiner*—Alan D. Diamond
*Attorney, Agent, or Firm*—Browdy and Neimark

[57] ABSTRACT

Use of an aqueous silica sol for obtaining a stabilized pickled white or a stabilized white from a hide, in particular by treatment of a hide at a pH between 1 and 8, at ambient temperature, in an aqueous or brine bath with a density between 1.014 and 1.09, with an aqueous silica sol containing by weight 10 to 50% silica in the form of discrete particles, not linked together by siloxane bonds and having an average diameter between 3 and 100 nm, and process for obtaining a pickled white.

19 Claims, No Drawings

SILICA SOLS FOR OBTAINING A HIDE WHICH IS CALLED A STABILIZED PICKLED OR WHITE OR STABILIZED WHITE

This application is a continuation of application Ser. No. 08/003,656, filed Jan. 13, 1993 now abandoned.

The present invention relates to the use of silica sols for obtaining a hide which is called a stabilized pickled white or a stabilized white.

Currently in the leather and hide industry a reliable and economical process is sought which allows the obtaining of an intermediate hide having undergone to certain operations of a cycle of conversion into leather, having long storage properties and capable of being rapidly subjected, according to customer requirements, to further steps to obtain the desired tanning and finish.

Until now, as a function of demand, the tanner uses, after manual selection, a raw hide in the tanning process in order to obtain the required article. This way of proceeding requires a significant stock of raw hides and leads to long delays in delivery as the conversion of a raw hide into leather generally requires more than a month. Consequently, the tanner would like to have at his disposal hides in an intermediate technological state, notably in a stablized pickled white or stabilized white state, which can be rapidly and reliably converted into the desired article.

The preparation of stablized whites by pretanning hides is known using mineral salts of certain metals such as aluminium, titanium, magnesium, which do not colour the hides and which raise their retraction temperature sufficiently to be able to carry out, without heat marks, the standard mechanical operations for thicknessing, then tanning and the desired finish. But the pretanning with mineral salts mentioned previously imparts to the hides properties related to the tanning agent used. In some very rare cases, they can be favourable, but generally they are a nuisance and require the tanner generally to carry out an elimination by rinsing or an appropriate detanning before the tanning operation necessary to produce the desired article. Also, it was recommended to prepare a stabilized white with an aldehyde tanning or with silicic monomers or polymers of low molecular weight; these processes lead to serious difficulties during tanning and/or final treatments: only superficial tanning, brittle leather.

In order to overcome these disadvantages, the Applicant has discovered that the use of an aqueous silica sol allowed the obtaining of a pickled white having excellent stability, physico-mechanical and thermal properties suitable for it to be subjected to standard mechanical operations without damage allowing a choice to be made regarding quality and thickness at this stage of the preparation and that the said use imparted no colouration to the hide by tanning, nor any noticable modification.

The present invention allows the obtaining from a fleshed or unfleshed, haired or dehaired, pickled or non-pickled hide, of an intermediate technological state having not only an excellent stability but also a better reactivity vis-à-vis tanning agents and a gelatinization temperature, designated hereafter GT, sufficient for protecting the hide against possible overheating.

This is why a subject of the present Application is the use of a silica sol, notably an aqueous silica sol, particularly an aqueous silica sol containing by weight 10 to 50% silica in the form of discrete particles, not linked to each other by siloxane bonds and having an average diameter of between 3 and 100 nm, for the obtaining of a stabilized pickled white or a stabilized white from a hide. As already indicated, the starting hide may be pickled or non-pickled, haired or dehaired, fleshed or unfleshed.

The term hide can designate, for example one of the following hides: ovine, bovine, caprine, porcine, equine, fish, reptilian such as boa, and more generally a hide of a land or sea mammal such as a sheep, kid, pig, goat, foal, heifer, cow, bullock, horse, reindeer, antelope, seal.

The expression pickled or non-pickled, haired or dehaired, fleshed or unfleshed hide, can designate, for example, a fell, a pickled fell, a fleshed and non-pickled fell, a fleshed and pickled fell, a non-pickled pelt, a pickled and split pelt, a non-pickled and split pelt.

By "stability" is meant in the present Application a physico-chemical and biological stability vis-a-vis microbial and/or fungicidial agents. Moreover, it was noticed with astonishment that the use of silica sols according to the present invention caused a noticable lowering of the activity of water on the treated hides, designated hereafter Aw (cf. Kirk-Othmer, Encyclopaedia of Chemical Technology, 3rd edition, volume 11, page 173—John WILEY and SONS, New York 1980), and due to this fact reduced the development of microorganisms on the treated hides thus allowing their storage without alteration for several months.

The aqueous silica sols containing 10 to 50% by weight of silica in the form of discrete particles not linked together by siloxane bonds, having an average diameter of 3 to 100 nm, are currently products sold commercially by the Applicant under the generic name "KLEBOSOL"®.

The use described above can in particular be implemented as follows: a hide is treated, before or after pickling, before or after dehairing, before or after fleshing, before or after splitting, at a temperature below 35° C. preferably at ambient temperature, at a pH between 1 and 10, preferably at a pH between 1 and 9 and more particularly at a pH between 1 and 8, in an aqueous bath or in brine solution with a density between 1.01 and 1.10, in particular between 1.014 and 1.09, with an aqueous silica sol.

By brine solution is preferably meant an aqueous solution of sodium chloride or other salts such as sodium sulphate or calcium chloride.

In the preferred conditions for implementing the invention, the treatment described above is carried out with an aqueous silica sol containing by weight 10 to 50% of silica in the form of discrete particles having an average diameter between 3 and 100 nm, in particular between 5 and 50 nm, preferably between 7 and 50 nm and more preferentially between 9 and 50 nm, not linked together by siloxane bonds.

The stabilized pickled whites or stabilized whites obtained according to the invention have in the working medium a gelatinization temperature of 65±1° C. This considerable elevation of the GT is particularly useful during the mechanical operations of slicing, fleshing or shaving, moreover, it allows calm and rapid working with no fear of burns, all the more so as the coefficient of friction of the hide is very considerably increased, thus improving behaviour during machine working.

Furthermore, the pickled or stabilized white hides produced according to the invention have a better reactivity vis-à-vis tanning agents when later subjected to tanning. The reasons are not known exactly, but it is noticed that the tanning is carried out in better conditions; a good penetration of the tanning agent throughout the entire thickness of the leather, uniform tanning both of the grain side and the flesh side, a lower consumption of tanning agent, leading ipso facto to a reduction in its proportion in the waste water.

Among the tanning agents subsequently usable on the intermediate hides of the present invention, the following may be mentioned: vegetable tannins, mineral tannins, organic tannins such as those extracted from oak wood, chestnut tree wood, sumac leaves, mirobolan pods, pine bark, quebracho wood, canaigre root, chromium derivatives such as chromium III sulphate, zirconium salts, aluminium salts such as aluminium sulphate, formaldehyde, polyphenols.

When a stabilized white obtained according to the present invention is subjected to a standard tanning with a usual chrome tanning agent such as chromium III sulphate, chromium III basic sulphate, a chromium salt masked with organic acids, a self-buffering or basifying chrome tannin, the quantities of residual chromium in the bath at the end of tanning are always less than 100 mg of chromium expressed in $Cr_2O_3$ per liter of bath.

The use according to the present invention is implemented very simply and very rapidly, for example in a milling machine for 1 to 24 hours, according to the method chosen and the operational parameters: pH, temperature, pressure, bath length.

The doses of aqueous silica sol used may vary greatly but usually 0.3 to 3% by weight is used expressed in $SiO_2$ relative to the weight of hides being treated. Depending on the doses used, the Aw of the treated hides can vary from 0.92 to 0.8.

At the end of treatment, the hides are generally tumbled, then stacked in piles and stored. They can also be drained and dried. In this case, they are treated with an agent which allows their rewetting and avoids crystallization of the mineral salts.

While storage of the stabilized whites obtained according to the present invention is an important advantage, such intermediate hide can also be used immediately in the tanning process, the stabilized whites which have not been dehaired can be dehaired, the stabilized whites which have not been fleshed can be fleshed, the stabilized whites in the form of pelts can be split and/or shaved or they can be tanned according to a conventional tanning process. In this way the present invention offers the tanner a wide choice of possibilities and great flexibility of operation in order to obtain the quality of leather he desires.

Another advantage of the use according to the present invention is the saving of waste products. In fact, the various waste products resulting from the mechanical operations are not contaminated by metals and/or tanning agents, other than the natural products present in the original hide they only contain silica. Due to this fact, these waste products can be easily used in other fields, such as the preparation of animal or human foodstuffs.

According to a variant of the present invention, it is possible to combine the use according to the invention with a pretanning with an aldehyde acid such as, and preferably, glyoxylic acid or one of its water-soluble salts. This pretanning can be carried out either before or after treatment of the fleshed or unfleshed, haired or dehaired, pickled or non-pickled hide, with a silica sol but preferably this pretanning is carried out after treatment with the silica sol.

In the case where this pretanning is carried out beforehand, the desired quantity of glyoxylic acid or one of its water-soluble salts is put in the brine solution used before the aqueous silica sol is introduced, then the other acids chosen to carry out the pickling and finally, the aqueous silica sol. In this way a stabilized pickled white is obtained which has been pretanned with glyoxylic acid or another.

In the case where this pretanning is carried out afterwards, it is then carried out in the standard manner in an aqueous bath containing the necessary quantities of sodium chloride and glyoxylic acid, at an acid pH in the presence of mineral and organic acids. In particular, it can be carried out according to the process described in the U.S. Pat. No. 4,978,361.

Also a subject of the present invention is a process for obtaining a stabilized pickled white or a stablized white from a hide which is pickled or non-pickled, haired or dehaired, fleshed or unfleshed, characterized by the fact that the hide is treated at a temperature below 35° C., preferably at ambient temperature, at a pH between 1 and 10, preferably at a pH between 1 and 9 and more particularly at a pH between 1 and 8, in an aqueous or brine bath with a density between 1.01 and 1.1, preferably between 1.014 and 1.09, with an aqueous silica sol containing by weight 10 to 50% of silica in the form of discrete particles, not linked together by siloxane bonds and having an average diameter between 3 and 100 nm, preferably between 7 and 50 nm.

The process described above can be implemented on the hides defined above, notably a fell, a pickled fell, a fleshed and non-pickled fell, a fleshed and pickled fell, a non-pickled pelt, a pickled pelt, a pickled and pared pelt, a non-pickled and pared pelt.

The above process is notably characterized by the fact that the silica particles of the aqueous silica sol have an average diameter between 9 and 50 nm. Preferably 0.3 to 3% by weight of silica is used relative to the weight of the pelts used.

The above process can be advantageously combined with a pretanning with an aldehyde acid or one of its water-soluble salts.

Also a subject of the present invention is the use of the stablized pickled white prepared by the process of the invention, for the obtaining of commercial leathers or hides. The stabilized pickled white or stabilized white resulting from the process of the present invention allows, in particular, the obtaining of a finished leather of good appearance, excellent grain quality, having neither marks, nor faults, nor burns and with a uniform colouration even when the finished article is coloured with pastel or light colours.

The following examples illustrate the present invention without however limiting it.

EXAMPLE 1

1,500 calf pelts of at least 4 kg gross weight having undergone to the standard operations of soaking, liming, bating and dressing, i.e. about 3,600 kg, are placed in a milling machine of 3 m diameter and 4 m wide, revolving at 4 revolutions per minute, in 85% of the bath by volume (approximately 3,000 L) of brine at density=1.055 (i.e. water containing about 7.5% sodium chloride), to which 1% by weight of concentrated sulphuric acid (36 kg) and 0.5% by weight of formic acid (18 kg) are added. The final pH of the bath is 2.5. Agitation takes place for 3 hours at ambient temperature, then the following is introduced into the milling machine:

240 kg of a commercial silica sol containing by weight 30% silica in the form of discrete particles, not linked together by siloxane bonds, with an average diameter of 50 nm, i.e. approximately 72 kg of silica (2% by weight relative to the weight of the skins).

Then agitation takes place for 10 minutes as previously, then the hides are tumbled, they are stacked or they are drained. In this way stabilized, pickled, white calf hides are obtained having good stability, a retraction temperature in the work bath of 66.2° C. (pH=2.5) and an electrovalent reactivity index of 3.8.

EXAMPLE 2

4,000 kg of sodium chloride brine solution with a density=1.075, then 1.200 lamb pelts each weighing about 1 kg are placed in a paddle with a diameter of 2 m and a length of 3.6 m, the paddle of which revolves at a speed of 60 revolutions per minute. Then agitation takes place for 3 hours at ambient temperature then 60 kg of concentrated sulphuric acid diluted with 500 kg of water is introduced into the bath. Agitation is continued until a homogeneous pH is obtained for a section of the hides. At this stage agitation is continued for another hour, then 80 kg of an aqueous silica sol is introduced containing 30% silica in the form of discrete particles not linked together by siloxane bonds, with an average diameter of 9 nm, i.e. 2% pure silica relative to the weight of the hides. Agitation is maintained for one hour then the hides are stacked in piles and finally allowed to drain for 48 hours and pressed before being packed and dispatched. On receipt they are rewetted for 2 to 3 hours in a brine bath of density=1.043 then they are fleshed. It is noted that this operation is performed easily and perfectly with complete separation of the fleshy and adipose part which detaches from the hide all in one piece, like a film.

EXAMPLE 3

The following are placed in a plastic tank:

25 Kg of sodium chloride, 500 g of orthoboric acid, 525 g of an aqueous solution of sodium hypochlorite with 3.5% active chlorine, 100 Kg of water.

The reaction medium is then agitated, then 13.3 Kg of an aqueous silica sol containing 30% by weight of silica in the form of discrete particles of an average diameter of 50 nm, and finally 200 Kg of partly fleshed and salted crocodile hides, rolled up in the form of cylinders of appropriate diameter and size are introduced. The reaction medium is left under agitation at ambient temperature until the bath has penetrated deeply. The hides are then taken out of the bath, resalted and sent to the user for their final conversion into tanned hide. It is noted that the presence of colloidal silica on the surface of the flesh side of the hides allows an effective fleshing to be carried out at the receiving works, suitable for degreasing and excellent quality tanning avoiding the surface marks noted on badly fleshed hides.

EXAMPLE 4

In a milling machine, revolving at a speed of 12 revolutions per minute, 7.5 kg of sodium chloride is dissolved in 142.5 kg of water, then 8 bated and dressed calf hides, that being about 100 kg, are introduced. After agitation for 30 minutes, the pH of the bath is 8.3 kg of an aqueous silica sol at 30% by weight of silica is introduced, the discrete particles of which have an average diameter of 9 nm, diluted in 12 kg of water. Agitation is continued for 150 minutes at ambient temperature then the bath is acidified to pH=2.8 with dilute sulphuric acid and with dilute formic acid then agitation is continued for 90 minutes. Next the hides are drained then fixed onto frames. The Aw value of the pickled hide is 0.920. The weight of the hides after draining and drying is 69 kg. The hides are then sliced to a thickness of 1.5 mm, then shaved to 1.3 mm in order to obtain after tanning a thickness of 1.5 to 1.6 mm. The weight of the shavings is 2.5 kg and the weight of the hides is 21 kg.

The hides are then treated in a bath consisting of 70 kg of water and 3.5 kg of sodium chloride. After agitation for 30 minutes, 140 g of concentrated sulphuric acid and 700 g of an aqueous solution of glyoxylic acid at 40% by weight are introduced into the bath so as to obtain a pH of the bath of 2.6. Agitation is continued for one hour then the chromium salts necessary to achieve a standard chrome tanning are introduced. At the end of tanning, the content of chromium salts in the bath is 0.035 g/l expressed as $Cr^{+++}$.

EXAMPLE 5

720 kg, i.e. 60 fleshed, trimmed, bated and dressed pelts, a section of which remains white in the phenolphthalein test (the pH of the last rinsing bath on dressing was 7.8), are placed in a tub 1 m wide and 2 m diameter, then 220 kg of water and 28.8 kg of sodium chloride are added. Agitation takes place for 30 minutes at ambient temperature. At this stage the pH of the bath is 8.2, its density is 4° Baume (density=1.0285). Then 21.6 kg of a silica sol at 30% by weight of silica in the form of discrete particles having an average diameter of 9 nm is introduced into the bath, then the whole is left under agitation for 150 minutes. The silica content of the bath decreases very rapidly, from 30 g/l it reduces to 8.6 g/l after 45 minutes of agitation, then to 3 g/l after 90 minutes and reaching 1.5 g/l after 150 minutes of agitation. The bath is then acidified to pH=2.8 by the addition of dilute sulphuric acid, then the hides are left for 1 hour under agitation and for 16 hours without agitation. The hides are then removed from the bath, stacked on pallets and allowed to drain for 24 hours. The Aw value of the pickled hide is 0.943. They are then dried and shaved in two batches. The first batch of 30 hides is shaved to 1.8 mm; in this way 200 kg of hides and 40 kg of shavings are obtained. The second batch of 30 hides is shaved to 2 mm; in this way 220 kg of hides and 20 kg of scrapings are obtained. These 60 kg of shavings are suitable for use in the food industry. The first batch is tanned with chromium with a pretanning with glyoxylic acid. To do this, the 30 hides (200 kg) are placed in a bath containing 40 kg of water, 10 kg of sodium chloride, 400 g of concentrated sulphuric acid and 1.6 kg of an aqueous solution of glyoxylic acid at 40% by weight. After agitation for 30 minutes at ambient temperature, 7.6 kg of chromium III salts at 33° Schorlemmer (chromium sulphate with a basicity index of 33%) is introduced into the bath, then agitation takes place for 90 minutes at ambient temperature and finally 3 kg of basifying salts (magnesium oxide) are introduced. Agitation takes place for 6 hours then the hides are left for 16 hours with 10 minutes of agitation every two hours. Then 100 kg water is introduced at 70° C., agitation is continued for one hour maintaining the temperature at 45° C. The tanned hides are removed and the residual chromium in the tanning bath is analyzed. 0.0125 g/l of chromium expressed as $Cr^{+++}$ is found.

The second batch is tanned with a vegetable tannin. To do this, the 30 hides (220 kg) are placed in a bath containing 110 kg of water and 14 kg of sodium chloride. After dissolving the salt, about 1.1 kg of sodium hyposulphite is introduced into the bath so as to obtain a pH of 3 and then 11 kg of a replacement tannin dissolved in 110 kg of water is introduced. After agitating for one hour 5.5 kg of a neutralizing agent is introduced before the addition of powdered vegetable tannin.

Perfectly tanned hides corresponding to the requirements of the user are obtained both with chrome tanning and with vegetable tanning.

EXAMPLE 6

3 tons of bated and dressed cow hides a section of which shows no colouration with phenolphthalein, 1116 liters of an aqueous solution at 12% by weight of sodium chloride and 1500 kg of water are placed in a milling machine. Agitation takes place for 30 minutes at 20° C. Then 90 kg of silica sol containing 30% by weight of silica in the form of discrete particles having an average diameter of 9 nm is introduced into the bath having a density of 1.030. Agitation takes place for 150 minutes, then the reaction medium is acidified with dilute sulphuric acid and dilute formic acid. Agitation is continued for 3 hours; at this stage the pH of the bath is 2.7. The whole is left for 16 hours at ambient temperature agitating for 10 minutes every 2 hours, then the hides are tumbled, stacked on palettes then 48 hours later they are dried, sliced, shaved and finally split into strips. The Aw value of the pickled hide is 0.925. The pared hides are then pretanned with glyoxylic acid then chrome tanned as in Example 5. At the end of tanning a bath containing 0.07 g/l of chromium expressed as $Cr^{+++}$ is obtained.

EXAMPLE 7

1.020 kg i.e. 350 bated and dressed calf hides having an ionic equilibrium point of 5.6 and giving a colourless section with regard to the phenolphthalein test and the last rinsing bath of which after dressing had a pH of 8, are placed in a milling machine.

Then 510 liters of an aqueous solution of sodium chloride at 20% by weight are introduced into the milling machine, then agitation takes place for 45 minutes. At this stage the pH of the bath is 8.1 and its density is 1.06. The reaction medium is acidified to a pH=4.5 by the addition of about 13 kg of acetic acid followed by agitation for 45 minutes and then 20.4 kg of a silica sol at 30% by weight of silica in form of discrete particles having an average diameter of 9 nm and 40.8 kg of water are introduced. The reaction medium is left under agitation for 3 hours then 17.3 kg of concentrated sulphuric acid is introduced over 40 minutes. The reaction medium is agitated for one hour then left for 16 hours with no agitation; the pH of the bath is 2.4. The hides are then taken out of the bath, stacked on pallets and left for 48 hours. The Aw value of the pickled hide is 0.836. At this stage the hides have a water content 4% lower than that noted in hides of the same origin which have been subjected to the same treatment without the silica sol. The hides are then fleshed and shaved. The fleshing and cutting operations are carried out effectively and the flesh sides are smooth and glossy. The fleshed and shaved hides are then tanned in a milling machine in a conventional manner with 5% by weight relative to the weight of the hides of a chromium III salt at 33° Schorlemmer (chromium sulphate with a basicity index of 33%) and with 25% by weight of $Cr_2O_3$, followed after two hours of agitation by the addition of 0.5% by weight of dolomite relative to the weight of the hides. Then the hides are left under agitation for 4 hours then for 16 hours under intermittent agitation of 5 minutes every hour. The final pH of the bath is 3.6 and its chromium salt content expressed in $Cr^{+++}$ is 0.13 g/l. The hides contain 4.1% $Cr_2O_3$ expressed relative to the dry weight.

EXAMPLE 8

500 liters (525.5 kg) of an aqueous solution of sodium chloride with a density of 1.051 and 1,000 kg i.e. 80 fleshed, trimmed, bated and dressed heavy calf hides are placed in a milling machine.

After agitation for 2 hours at 10 revs/minute at ambient temperature, 60 kg of an aqueous solution containing 10 kg of 98% concentrated sulphuric acid is introduced, then the agitation is continued for 30 minutes, the pH of the bath is 2.2. Then 20 kg of a silica sol is introduced containing 30% by weight of silica in the form of discrete particles having an average diameter of 50 nm. After agitating for 30 minutes the silica content of the bath is 0.2 g/l which indicates a virtually total adsorption of the silica by the hides. At this stage, a solution containing 8 kg of an aqueous solution of glyoxylic acid at 40% by weight in 20 kg of water is introduced, then agitation is continued for 30 minutes. The pH of the bath is 2.4. Then 38 kg of a powdered chromium salt is introduced followed by agitation for 2 hours then 15 kg of a self-basifying chromium salt is introduced.

After six hours of agitation, the reaction medium is left overnight with 5 minutes of agitation per hour. The next day 500 kg of water at 75° C. is introduced into the reaction medium which is at 38° C., and after one hour of agitation the temperature of the medium is 45° C. The hides are removed from the bath, they have a very fine grain, they are pliable, no wrinkles are noticed, the tail stripe is not noticeable.

The bath contains 0.02 g/l of chromium in the $Cr^{+++}$ state and after filtration it is recycled for use in a new operation.

The finished leather has excellent grain side adhesion and a surface increase of 3%, a full feel, an exceptionally fine grain, a belly section which considerably reduces cutting requirements.

We claim:

1. In a method for stabilizing an untanned split hide to form an untanned split pickled or stabilized white which can be subsequently tanned, comprising treating the hide with a brine solution having a density between 1.01 to 1.10, the improvement comprising adding a pretanning amount of an aldehyde acid or a water-soluble salt thereof and an amount effective of silica sol, to make the untanned split hide resistant to attack by microorganisms, to the brine solution before or during the treatment to form an aqueous silica sol containing about 0.3 to 3% by weight of said silica based on the weight of said hide, and then storing the resultant pickled white or stabilized white hide containing silica prior to tanning.

2. A method according to claim 1, wherein said hide is a pickled untanned split hide.

3. A method according to claim 1, wherein said untanned split hide is dehaired.

4. A method according to claim 1, wherein said untanned split hide is not fleshed.

5. A method according to claim 1, further comprising subsequently tanning said pickled or stabilized white hide.

6. A method in accordance with claim 1, wherein said storing is for at least one month.

7. A method according to claim 1, wherein said hide to be stabilized is already fleshed.

8. A method according to claim 5, wherein said tanning is a chromium tanning and wherein, at the end of tanning, the content of chromium salts in the tanning bath is from 0.0125 to 0.13 g/l of chromium expressed as $Cr^{+++}$.

9. A method of tanning a hide consisting essentially of soaking a fleshed untanned hide with a solution at a pH between 1 and 9, below 35° C., having a solution density between 1.014 and 1.09 and containing a pretanning amount of an aldehyde acid or a water-soluble salt thereof and an effective amount to make the fleshed untanned hide resistant to microorganism attack, of an aqueous silica sol containing 10 to 50% by weight silica in the form of discrete particles, not linked together by siloxane bonds and having an average diameter between 3 and 100 nm, said silica being present in an amount of about 0.3 to 3% by weight based on the weight of said hide, for a time sufficient to obtain a pickled or stabilized white, storing said pickled or stabilized white for at least a month; and then subjecting said pickled or stabilized white to chromium tanning without any intermediate detanning.

10. A method according to claim 9, wherein said pH is between 1 and 8.

11. A method according to claim 9, wherein silica particles of said aqueous silica sol have an average diameter between 7 and 50 nm.

12. A method according to claim 11, wherein said silica particles of said aqueous silica sol have a diameter between 9 and 50 nm.

13. A method according to claim 11, wherein said pH is between 1 and 8.

14. A method according to claim 9 wherein said solution is brine.

15. In a method for the chromium tanning of a hide comprising the steps of splitting fleshing and bating, followed by chromium tanning, the improvement comprising:

prior to said chromium tanning, treating the split fleshed and bated hide with a solution containing a pretanning amount of an aldehyde acid or a water-soluble salt thereof and an amount sufficient of particles of silica having an average diameter between 3 and 100 nm in the range of 0.3 to 3% by weight of said silica based on the weight of said hide to obtain a pickled or stabilized white.

16. A method of making a pre-tanned and intermediate white hide comprising:

pre-tanning a hide in a solution containing a pre-tanning amount of an aldehyde acid or a water-soluble salt thereof, and treating said hide at less than 35° C. in a solution containing an amount sufficient of a silica sol to make the hide resistant to attack by microorganisms, said solution having a pH between 1 and 9 and a solution density of between 1.014 and 1.09, said silica sol containing 10–50% by weight silica in the form of discreet particles, not linked together by siloxane bonds and having an average diameter of between 3 and 100 nm.

17. A method according to claim 16 wherein said aldehyde acid or water-soluble salt thereof is glyoxylic acid or a water-soluble salt thereof.

18. A method according to claim 16 wherein said pretanning and said treating are carried out sequentially.

19. A method according to claim 18 wherein said treating is carried out first, followed by said pretanning.

* * * * *